US006032872A

United States Patent [19]

Dupre

[11] Patent Number: 6,032,872

[45] Date of Patent: Mar. 7, 2000

[54] APPARATUS AND METHOD FOR MAKING SNOW

[76] Inventor: Herman K. Dupre, c/o Seven Springs, Champion, Pa. 15622

[21] Appl. No.: 09/075,539

[22] Filed: May 11, 1998

[51] Int. Cl.[7] ..... F25C 3/04

[52] U.S. Cl. ..... 239/14.2; 239/416.4; 239/416.5; 239/423

[58] Field of Search ..... 239/2.2, 14.2, 239/416.4, 416.5, 418, 419, 423

[56] References Cited

U.S. PATENT DOCUMENTS

| | | | |
|---|---|---|---|
| 3,706,414 | 12/1972 | Dupre | 239/14 |
| 3,822,825 | 7/1974 | Dupre | 239/14 |
| 3,897,904 | 8/1975 | Kiegerl | 239/14.2 |
| 3,952,949 | 4/1976 | Dupre | 239/2.2 |
| 4,214,700 | 7/1980 | Vanderkelen et al. | 239/2.2 |
| 4,597,524 | 7/1986 | Albertsson | 239/14.2 |
| 5,004,151 | 4/1991 | Dupre | 239/2.2 |
| 5,154,348 | 10/1992 | Ratnik et al. | 239/14.2 |
| 5,180,105 | 1/1993 | Teague | 239/14.2 |
| 5,810,251 | 9/1998 | McKinney | 239/2.2 |
| 5,823,427 | 10/1998 | Dupre et al. | 239/14.2 |

*Primary Examiner*—Andres Kashnikow
*Assistant Examiner*—Robin O. Evans
*Attorney, Agent, or Firm*—Carothers & Carothers

[57] ABSTRACT

A snow making tower which includes an elongated tower pipe mounted on a support with a first water discharge nozzle adjacent the upper end of the tower pipe. A water connection is provided at the lower end of the tower for connection of a source of water under pressure to supply the water under pressure to the first water nozzle at the upper end of the tower. An air conduit coextends within the tower pipe with the bottom end of the air conduit extending externally of the pipe tower for connection to a remote source of air under pressure. The top end of the air conduit terminates within or inside the tower pipe adjacent the upper end where the air and water are then intermixed adjacent the water nozzle and then ejected through the water nozzle. An air nozzle may also be provided at the upper end of the tower for ejecting a stream of air into the ambient atmosphere under pressure into the throat of an air/water spray from the water nozzle or nozzles to further atomize the water spray. A second water discharge nozzle is positioned adjacent the first water nozzle. The second water nozzle is provided with a separate conduit connection for independently suppling water under pressure to the second water nozzle for discharge into the ambient atmosphere. The water supply to this second nozzle is regulated with a valve and the second water nozzle is replaceable with nozzles of different aperture size for permitting adjustment for producing maximum quality snow under different ambient subfreezing conditions.

26 Claims, 4 Drawing Sheets

APPARATUS AND METHOD FOR MAKING SNOW

BACKGROUND OF THE INVENTION

This invention relates generally to the art of fluid sprinkling and more particularly to the manufacture of snow with elongated pipe-type snow making towers.

Numerous systems have been developed for artificially producing snow with tall or elongated pipe-type snow making towers which extend above ground anywhere from twelve to fifty plus feet. Two well known different techniques are employed for manufacturing snow with such towers. The first is an older technique wherein air and water under pressure are mixed together internally at the base of the pipe-type snow making tower and then the combination is ejected at the upper end of the tower into the ambient atmosphere in subfreezing conditions through snow making nozzles. This well known system is described in the present inventor's U.S. Pat. No. 3,706,414.

The advantage of such elongated pipe-type snow making towers is that the air line terminates at the tower base so that there is no exposed elongated air line to freeze, and due to the height of the tower, a long dwell time is obtained. Dwell time is the time between the time the seed crystals are formed upon discharge from the nozzles and the time the snow crystals, as formed from seed crystals, finally settle upon the underlying ground or ski slope.

One problem encountered with the snow making towers of the type disclosed in the inventor's U.S. Pat. No. 3,706,414, wherein the air and water under pressure are mixed at the base of the elongated pipe tower, is that obviously the internal water pressure can never exceed the air pressure. If this should occur, the water would back down the air supply line and prevent any air from entering into the mix.

Another disadvantage of this type of system is that the air pressure entering the lower end of the tower is not the same pressure as the air pressure or mixed fluid medium at the top of the tower which is ejected through the nozzles. In other words, a tremendous amount of energy is lost. For example, if the air compressor utilized to supply the tower has a capacity of 100 psi pressure, it would obviously be desirable to maintain this 100 pound pressure at the highest point of discharge on the tower.

Actual tests show, however, that the maximum effective air pressure discharge in such a tower at 35 feet above the ground is only approximately 85 pounds. Thus, with this type system one is faced with a 15 pound efficiency loss in air pressure, which of course greatly decreases the quality and quantity of snow being manufactured. In order to alleviate this problem, the present inventor conceived the snow making tower illustrated and described in U.S. Pat. No. 3,822,825 wherein the water and air under pressure are externally mixed at the top of the tower and the air line is insulated within the water line making up the pipe structure for the snow making tower to prevent freeze-up in the air line. To date, this method of external mixing of the air and water has proved to be the most efficient and is the most followed practice for elongated pipe-type snow making towers.

However, the present inventor has conceived a new apparatus and method whereby the advantages of both such prior art methods may be taken advantage of and utilized and whereby additionally the aforementioned problems with intermixing of air and water under pressure in snow making towers of the type disclosed in the inventor's U.S. Pat. No. 3,706,414 are effectively diminished.

SUMMARY OF THE INVENTION

The elongated pipe snow making tower of the present invention is provided with one or more first water discharge nozzles adjacent the upper end of the tower pipe and the water connection, in typical fashion, is provided at the lower end of the tower pipe for connection to a source of water under pressure to supply the water under pressure through the tower pipe to the water nozzles at the top of the tower pipe for discharge into the ambient atmosphere.

However, with the apparatus and method of the present invention, an air conduit is also provided and it coextends within the tower pipe from its base to the upper end so that it is fully insulated with a water jacket by the water flowing within the tower pipe, and the bottom end of this air conduit extends externally of the tower pipe for connection to a remote source of air under pressure. Air is supplied under pressure, not to the bottom end of the tower as is taught by the prior art, but instead, directly to the top end of the air conduit where it terminates inside the tower pipe adjacent the upper end of the tower pipe. Thus the internal mixing of air and water occurs at the upper end of the tower, instead of at the base of the tower, thereby preserving the maximum air pressure possible until the point of intermixing and discharge at the upper end of the tower pipe.

In the configuration of the present invention, a valve is connected to the water supply connection for regulating the pressure of the water supplied to the tower pipe. T his is preferably a gate valve which may be best utilized to regulate the water pressure within the tower.

A water pressure meter is also connected between this gate valve and the base water connection to the tower for indicating the water pressure in the tower pipe so that the operator can precisely adjust the water pressure for the particular air pressure conditions provided and for the ambient atmospheric temperature conditions.

Another feature of the present invention, which may be utilized independently of the afore described invention or in combination therewith, is that the water connection of the pipe snow making tower exits the lower end of the pipe tower directly in line with the tower pipe and the air connection exits the lower end of the tower pipe at an angle to the pipe tower. Previously, the connections to the tower were reversed.

When water under pressure is caused to make sharp angled bends through pipe connections, much of the water pressure is lost due to friction losses, whereas air under pressure can readily make right angled turns through pipe connections with minimal friction loss. Accordingly, with this improved connection, maximum air and water pressure are supplied to the tower.

In another embodiment of the present invention, the air conduit at the upper end of the tower pipe may additionally terminate to an air nozzle positioned for ejecting a stream of air therefrom to ambient atmosphere under pressure into the throat of an air/water spray from the aforementioned nozzle or nozzles to further atomize the water spray. The top end of the air line at the upper end of the tower also terminates in the pipe tower adjacent the upper end as previously described, but in this embodiment exits through a biased check valve that is bias to release air into the interior of the tower pipe at its upper end at a predetermined threshold pressure.

Yet in another embodiment of the present invention the first water discharge nozzle is provided with an inlet tube that feeds the first nozzle from a bottom tube inlet and this tube extends downwardly into the elongated tower pipe with its bottom inlet positioned below the top end of the air conduit outlet. This positions the inlet for this tube below the water level inside the elongated tower.

In this embodiment, a second water discharge nozzle is positioned adjacent the first water nozzle. This second water nozzle is provided with a separate supply conduit that is connected for independently supplying water under pressure from the water source to this second water nozzle for discharge into ambient atmosphere.

The second water nozzle is a detachable nozzle so that it may be readily replaced by nozzles of different aperture size which thereby permits one to make proper adjustment for producing maximum quality of snow under different ambient subfreezing conditions.

The first and second water nozzles are preferably inclined towards each other whereby their respective ambient discharges will co-mingle and thereby provide additional atomization of the external sprays for producing quality snow in subfreezing ambient conditions.

A conduit valve is connected to this separate water supply conduit for independently regulating the supply of water under pressure to the second water nozzle. This conduit valve is preferably a three-way valve connected for draining this separate conduit when the valve is off so that water cannot remain in this additional or separate conduit and freeze when not in use.

This separate conduit may coextend within the tower pipe. However, this is not necessary and in fact this separate conduit may coextend along the exterior of the elongated tower pipe if desired.

The water connection at the lower end of the elongated pipe tower includes a pressure regulating valve, normally in the form of a gate valve, that is connected for regulating the pressure of water supplied to the lower end of the tower pipe. A water pressure gauge is also disposed between this pressure regulating valve and this water connection at the bottom of the tower for reading water pressure supplied through the pressure regulating valve to the lower end of the tower pipe.

An air valve is also connected to the air conduit for regulating the supply of air under pressure to the air conduit within the pipe tower. An air pressure gauge is connected to the air valve for reading air pressure supplied to the air valve. Additionally, a third water valve is further connected for regulating the supply of water under pressure to the additional water supply conduit for the second water nozzle and the pressure regulating valve that feeds the bottom end of the tower pipe with water under pressure as regulated by this pressure regulating valve.

All of these valves and gauges permit one to accurately adjust the snow making tower of the present invention under varying ambient subfreezing temperature conditions to permit the operator to adjust the tower for making maximum quality snow under different or varying ambient subfreezing conditions.

For ease of maintenance and for changing out nozzle structures, the entire upper end of the tower, together with the water and/or air nozzles, and with or without the afore described bias check valve, may be removed in one piece as a detachable head unit of the pipe tower.

BRIEF DESCRIPTION OF THE DRAWINGS

Other objects and advantages appear in the following description and claims.

The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 1:
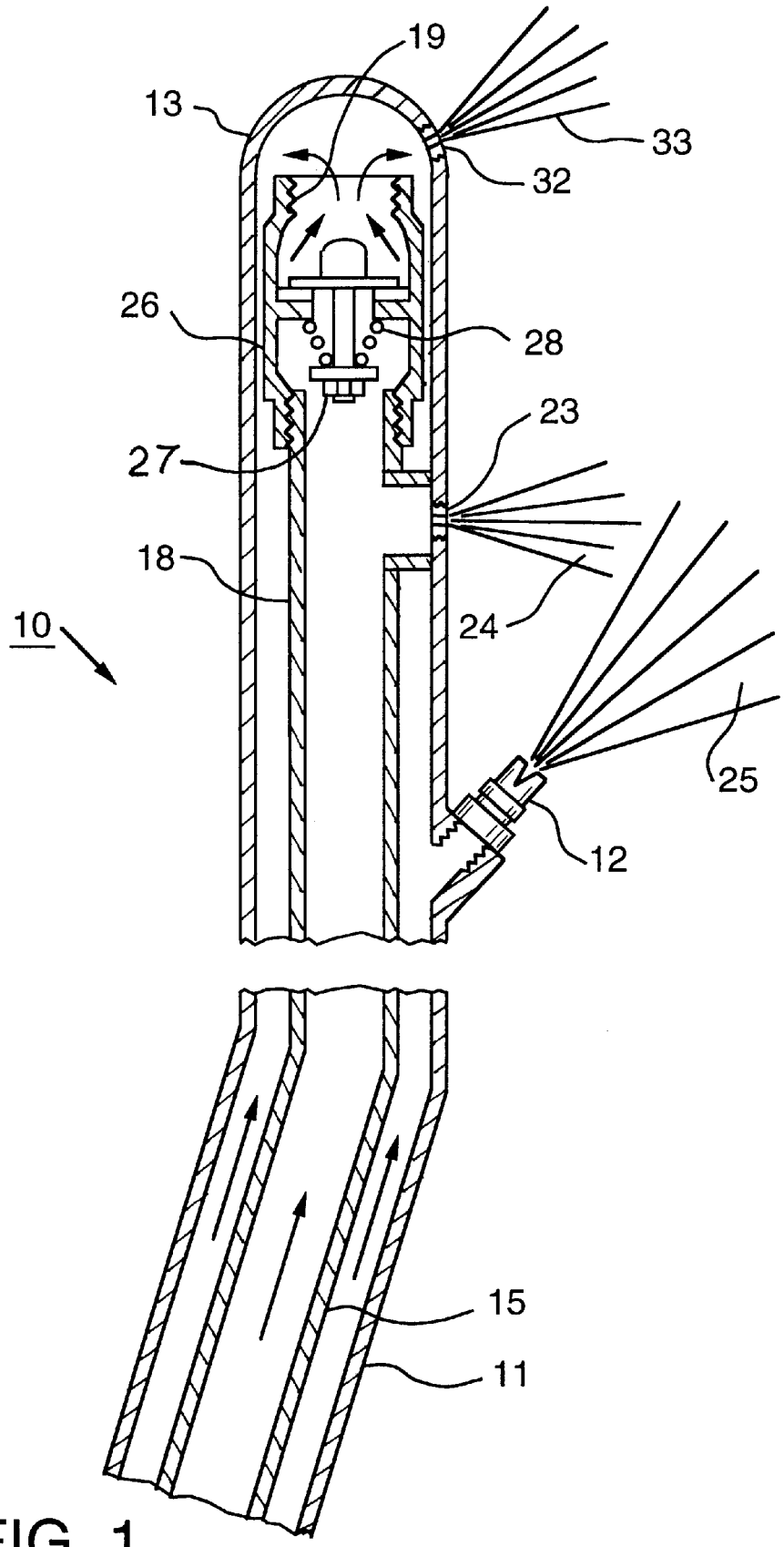
FIG. 1 is a view in side elevation of the upper end of the snow making tower of the present invention shown in vertical mid cross section.

Referring to the drawings, the snow making tower 10 of the present invention includes an elongated tower pipe 11 mounted on a support. For purposes of clarity, the support 31 is shown only schematically and reference should be had to the aforementioned patents and others for many different types of ground support systems which are available to support the tower 10 in its upright position on a ski slope.

A water discharge nozzle 12 is provided adjacent the upper end 13 of tower pipe 11 and a water connection 14 is provided at the lower end of tower pipe 11 for connection to a source of water, usually remote, under pressure for supply thereof through the outer pipe 11 of the tower 10 to nozzle 12 for discharge into the ambient atmosphere.

An air conduit 15 coextends within tower pipe 11 and the bottom end 16 thereof extends externally of tower pipe 11 for connection to a remote source of air under pressure at coupling 17 in order to supply air under pressure through coextending inner air conduit 15 to the upper end 18 thereof.

The upper end 18 of air conduit 15 terminates inside tower pipe 11 at outlet 19 where the air is then intermixed with the water within outer tower pipe 11 and ejected through nozzle 12 as an air/water mixture for manufacture of snow in subfreezing ambient conditions.

Multiple water nozzles 12 may be provided, but should be provided in substantially the same horizontal plane to obtain equal air/water mixes.

A gate valve 20 is connected to the water connection 14 for regulating pressure of water supplied to the tower pipe 15. In addition, a water pressure meter 21 is also connected between valve 20 and the base of tower pipe 11 for indicating water pressure in tower pipe 11.

As is taught in the inventor's prior art patents, the air conduit 15 for its full coextending length within pipe tower 11 is insulated by the water flowing within tower pipe 11 which acts as an insulating jacket and prevents freeze-up of moisture within air conduit 15.

An extra small weep nozzle 32 is provided at upper end 13 to provide additional mixed spray 33 for making extra snow and for evacuation of excessive air from upper end 13 to minimize the possibility of ice accumulating on the exterior of head 13.

Figure 2:
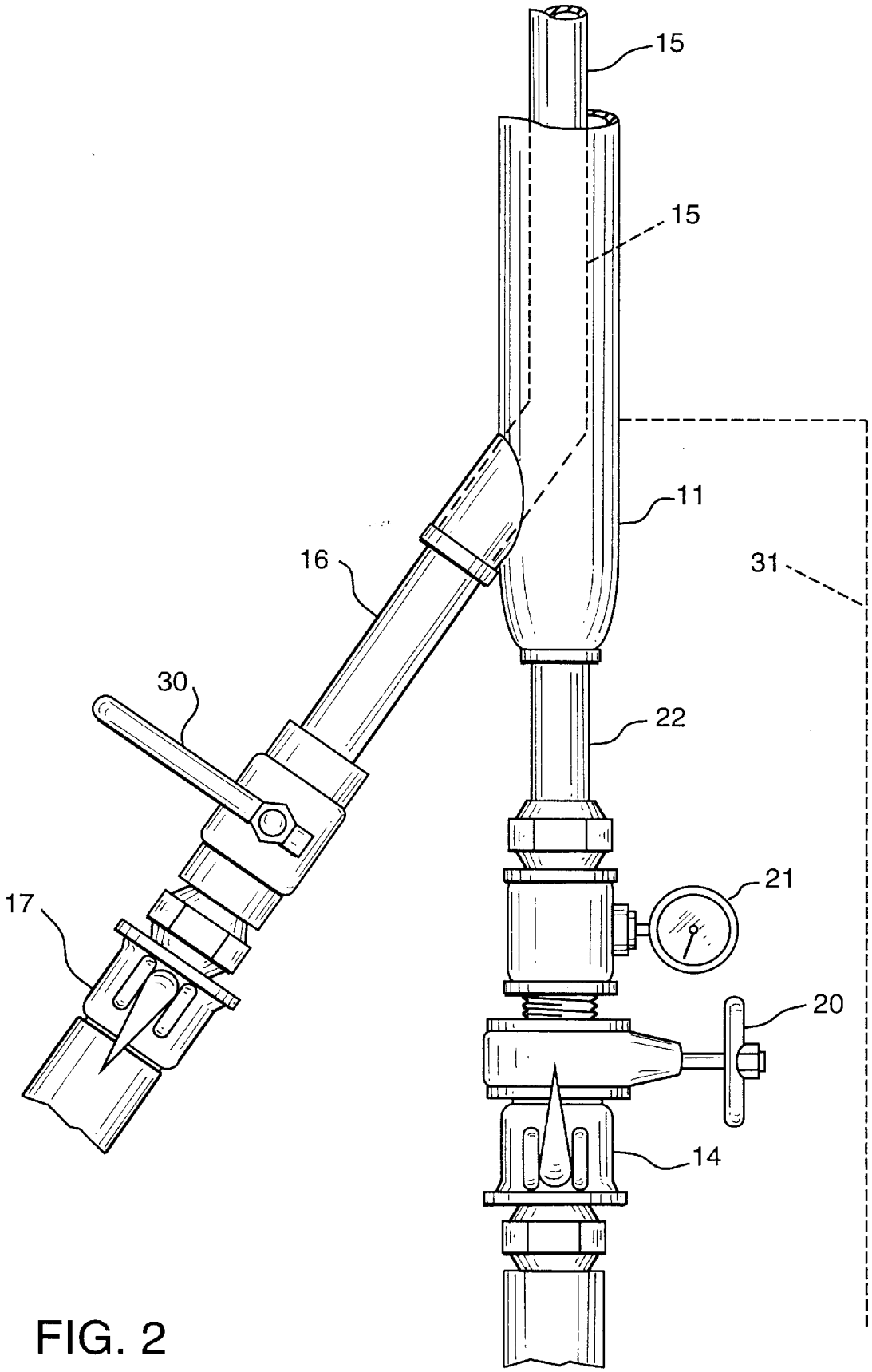
FIG. 2 is a view in side elevation showing the bottom or base portion of the snow making tower illustrated in FIG. 1.

With particular reference to FIG. 2, the water connection 14 via water pipe 22 exits the lower end of tower pipe 11 in direct line therewith and the air connection 17 exits tower pipe 11 via conduit 16 at the lower end thereof at right angles as illustrated.

As previously explained, this feature of the present invention permits the water under pressure to flow in direct line with the tower pipe. This supplies water under pressure to tower pipe 11 with greater efficiency and less loss due to friction previously experienced in prior art pipe towers wherein the water is fed to the base of the tower through right angle connections.

Air under pressure flowing through right angle connections as illustrated in FIG. 2 does not lose pressure through friction loss to the degree that water does when caused to go through right angle turns.

The top end 18 of air conduit 15 terminates also, and alternatively, to an air nozzle 23 positioned adjacent the upper end 13 of tower pipe 11 for ejecting a stream of air therefrom to ambient atmosphere under pressure into a throat 24 of air/water spray 25 emanating from nozzle 12 in order to further atomize the water spray for the manufacture of better quality snow.

The top end 18 of air conduit 15 also terminates internally in tower pipe 11 adjacent the upper end 13 through biased check valve 26 which is biased under spring pressure to release air under pressure into the interior of the upper end of tower pipe 11 at a predetermined threshold pressure, which is of course adjustable depending upon the adjustment of threaded adjustment nut 27 and the characteristics of compression spring 28.

While only one water/air nozzle 12 and air nozzle 23 are illustrated, of course multiple air such nozzles 12 and multiple such air nozzles 23 may be provided as is taught by the aforementioned prior art references.

Because the air under pressure is delivered to the top of tower pipe 11, instead of to the bottom thereof as taught by the prior art, before it is internally mixed, the snow tower 10 can be run or operated at much greater efficiencies than the air/water internal mixing pipe towers of the prior art.

For example, to operate the tower 10 illustrated, if water is delivered under pressures greater than 150 psi to connection 14 and air under pressure is delivered to connection 17 typically at 125 psi. 80 psi is a sufficient minimum to operate such a snow making tower.

The ball valve 30 i, first turned off to turn off the air and then gate valve 20 is closed down until gauge 21 indicates that the water pressure is at 40 psi.

The air is then turned back on via ball valve 30 and the tower 10 will operate to produce better quality snow than heretofore possible with prior art snow making towers which intermix the air and water internally.

The increased efficiency in air delivered under pressure directly to the top 13 of tower 10 greatly increases the water/air pressure escaping nozzle 12 over the prior art towers making the tower 10 operate much more efficiently and causing it to manufacture better quality snow than heretofore possible with internal intermixing towers.

In fact, it is believed that the snow making tower of the present invention is at least as twice as efficient as other air/water internal intermixing guns or pipe towers because much greater amounts of nucleation of the water occurs when ejected at the top of tower 10 thereby creating better quality snow at higher ambient temperatures.

The check valve 26 prevents water from entering the air supply system in air conduit 15 and will not permit air under pressure to exit internally into the upper end of tower 10 at port 19 unless the air pressure at that point exceeds the water pressure.

Next referring to the embodiments of FIG. 3 through 6, similar elements are designated with the same reference numerals.

In this embodiment, the snow making tower 10 of the present invention includes two water discharge nozzles, first nozzle 12 and second nozzle 38, which respectively provide water spray discharges 25 and 40 into the ambient atmosphere.

First water nozzle 12 is provided with inlet tube 34 feeding nozzle 12 from its bottom inlet 41. Inlet tube 34 extends downwardly into elongated tower pipe 11 such that the inlet 41 is positioned below the top outlet end 19 of air conduit 15. This configuration also positions tube inlet 41 below the water level 36 within elongated tower pipe 11.

While first water nozzle 12 is replaceable, it generally under all conditions of operation may be left in place and has a small aperture, such as is generally known in the industry as a 40.07 nozzle.

Second nozzle 38 is detachable for replacement by other nozzles 38 of different aperture size. This permits the operator to produce a maximum of quality snow under different ambient subfreezing conditions.

Second water nozzle 38 is provided with a separate supply conduit 37 connected for independently supplying water under pressure from the same water source supplied to the tower from pipe 50. This supply conduit 37 is shown as being internally positioned within elongated tower pipe 11. However, conduit 37 may run externally of tower pipe 11 if desired.

First and second water discharge nozzles 12 and 38 are threadably secured in upper aluminum head plug 51 of the tower and they are respectively received in threaded steel reducer insert sleeves 58 which permit repeated insertion, substitution and removal of first and second water nozzles 12 and 38 without binding on the softer metal of aluminum head plug 51. Head plug 51 is welded to the top of elongated tower pipe 11 as illustrated in FIGS. 3 and 4.

Figure 3:
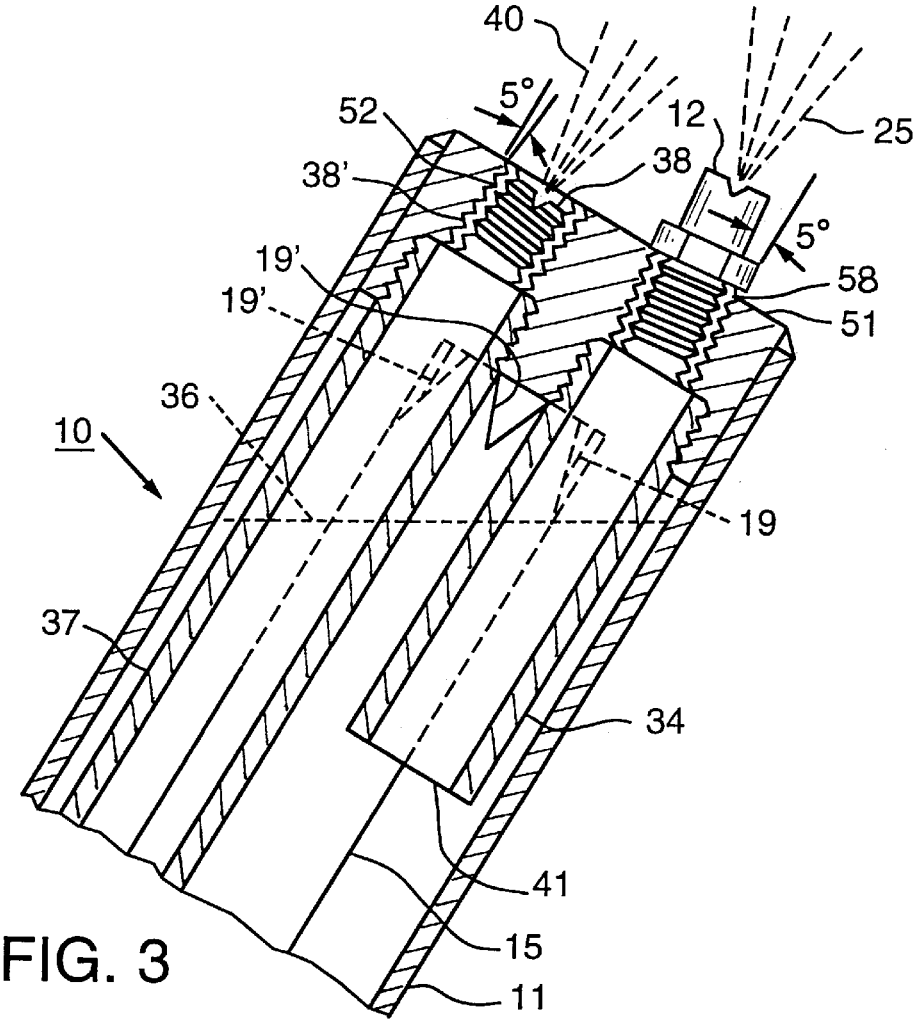
FIG. 3 is a view in side elevation of the upper end of the snow making tower of the present invention shown in vertical mid cross section and illustrating another embodiment of the snow making tower of the present invention.
Figure 4:
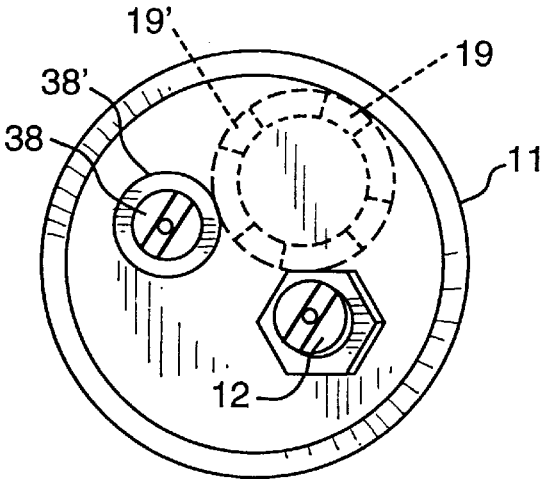
FIG. 4 is a top view of the upper end of the snow making tower shown in FIG. 3.
Figure 5:
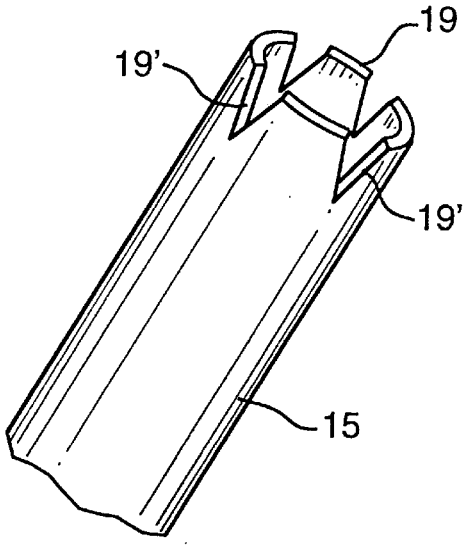
FIG. 5 is a perspective view of the upper end portion of the air supply conduit within the upper end of the snow making tower illustrated in FIG. 3 as shown alone in order to illustrate detail of construction.

Second water nozzle 38 is imbedded into head plug 51 as illustrated in FIG. 3 so that ice will not accumulate or buildup on top of second nozzle 38, as would be the case if it were permitted to extend upwardly beyond the top of tower pipe 11 and head plug 5 1.

First and second water nozzles 12 and 38 are also inclined towards each other respectively by 5° each as illustrated in FIG. 3 whereby the respective ambient discharges 25 and 40 will comingle for providing additional atomization of the spray discharges. Such additional atomization provides for finer water particles or seed crystals and better quality snow.

The upper end 19 of air conduit 15 is provided with notches 19' so that if the upper end 19 is inserted within elongated tower pipe 11 until it engages the underside of head plug 51, air under pressure from within air conduit 15 will still have adequate egress to the interior of the upper portion of tower pipe 11. The air ejecting from outlet 19 flows under pressure against the inside of head plug 51 of tower pipe 11 and thereby helps to keep the head of the tower sufficiently warm to prevent ice buildup thereon on the outside.

Figure 6:
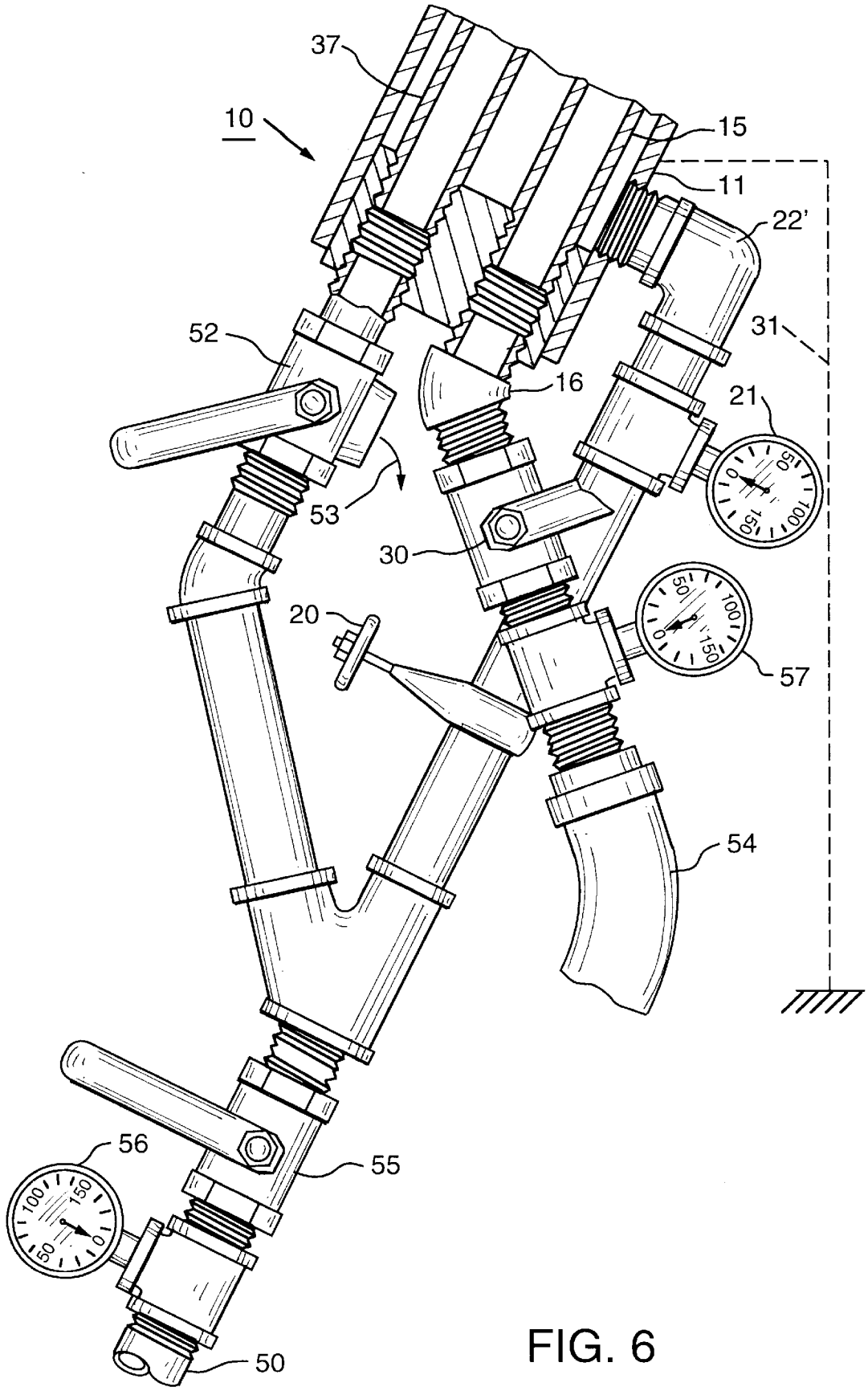
FIG. 6 is a view in side elevation showing the bottom or base portion of the snow making tower illustrated in FIG. 3 showing the supply connections to the base of the tower structure.

With particular reference to FIG. 6, conduit valve 52 is connected to the bottom of separate water conduit 37 for independently regulating the supply of water under pressure to second water nozzle 38 from the source 50. Valve 52 is a three-way valve for draining separate conduit 37 completely when valve 52 is in its, off position as indicated by the drain arrow 53.

Water connection 22' at the lower end of elongated tower pipe 11 is provided with a water pressure regulating gate valve 20 connected for regulating the pressure of water supplied to the lower end of tower pipe 11. Water pressure gauge 21 is also disposed between pressure regulating valve 20 and water connection 22' for reading water pressure supplied through pressure regulating valve 20.

An air valve 30 is also connected to air conduit 15 for regulating the supply of air under pressure to air conduit 15 from the source of air under pressure as supplied through connection hose 54.

A third water value 55 is connected to the water supply line 50 for regulating the supply of water under pressure to both the additional conduit 37 via valve 52 and to the bottom of tower pipe 11 via gate pressure regulating valve 20.

A water pressure gauge 56 is preferably connected to the inlet of water valve 55 and an air pressure gauge 57 is preferably connected to the inlet of air valve 30.

All of these valves and gauges permit accurate regulation of the snow making tower 10 of the present invention during different ambient subfreezing conditions.

As an example of operation of the tower construction illustrated in FIGS. 3 through 6, at high ambient subfreezing temperatures of, for example, 28° F., valve 52 will be turned off and only nozzle 12 will operate with its small aperture.

As the temperature decreases, for example to 20° F., a water nozzle 38 with a small aperture (size 5020) may be operated by turning on valve 52.

As the temperature decreases further, for example to 10° F., water nozzle 38 may be replaced by another water nozzle 38 which has a larger aperture so that maximum snow may be manufactured under the very cold subfreezing ambient conditions.

To make these changes, one first closes off air valve 30 (see FIG. 6) in order to provide valid water pressure readings on meters 21 and 56. Water pressure gauge or meter 56 should normally read at least 200 p.s.i. When valve 55 is off Valve 20 is then regulated to attain the desired water pressure (for example 40 p.s.i.) so that the water will not back down the air pipe when the air is again turned on with valve 30.

Valve 30 is thereafter turned on to provide maximum air under pressure (typically 118 p.s.i.) to the tower. In this configuration, one is thereby always utilizing maximum available air under pressure.

As ambient temperatures further decrease, water under pressure (200 p.s.i. or greater) may be supplied to second nozzle 38 via valve 52.

The apparatus illustrated in FIG. 3 through 6 has certain disadvantages and advantages with regard to the structure shown in FIG. 1.

The disadvantage is that the structure of FIG. 3 cannot be operated to provide any external mixing of the air and water under pressure as illustrated in the structure of FIG. 1. In addition, full internal mixing does make snow at higher temperatures than external mixing, but at a greater cost as the system is less efficient.

An advantage of the structure illustrated in FIG. 3 though 6 is that it is easily adaptable for different ambient subfreezing conditions, and moreover may be utilized in lower pressure systems constructed for home use wherein a maximum of 150 psi is experienced in the fluids exiting the nozzles, which is much less than the standard 300 psi used for commercial snow making towers, thereby making the pressures lower and more reasonable and safer for home use.

Other advantages of the structure of FIGS. 3 through 6 is that it manufactures more and better quality snow than the structure of FIG. 1 and additionally, the structure of FIG. 1 requires the inclusion of a check valve 26 which in and of itself requires the wasteful use of expensive air under pressure to permit it to function or to permit the air pressure to overcome the pressure of check valve spring 28. Also, the structure of FIG. 1 does not provide a second water nozzle 38 as is provided with the structure of FIGS. 3 through 6 which can be independently regulated with the supply of water under pressure and comingled with the discharge of the first water nozzle.

I claim:

1. A snow making tower comprising: an elongated tower pipe mounted on a support and having upper and lower ends with a first water discharge nozzle adjacent the upper end of said tower pipe and a water connection at the lower end of said tower pipe for connection to a source of water under pressure for supply thereof through said tower pipe to said first water discharge nozzle for discharge into ambient atmosphere; an air conduit having top and bottom ends and coextending within said tower pipe with the bottom end thereof extending externally of said tower pipe for connection to a source of air under pressure for supply thereof to said top end; said top end of said air conduit terminating inside said tower pipe for ejecting air from the termination into the interior of said tower pipe adjacent the upper end thereof.

2. The snow making tower of claim 1 including a valve connected to said water connection for regulating pressure of water supplied to said tower pipe.

3. The snow making tower of claim 2 wherein said valve is a gate valve.

4. The snow making tower of claim 3 including a water pressure meter connected between said valve and said water connection for indicating water pressure in said tower pipe.

5. The snow making tower of claim I wherein said water connection exits the lower end of said tower pipe in line therewith and said air connection exits the lower end of said tower pipe at an angle thereto.

6. The snow making tower of claim I wherein the top end of said air conduit terminates to an air nozzle positioned for ejecting a stream of air therefrom to ambient atmosphere under pressure into a throat of an air/water spray from said first water nozzle to further atomize water spray discharged from said first water nozzle, said top end also terminating in said tower pipe adjacent said upper end through a biased check valve which is biased to release air into the interior of said tower pipe at a predetermined threshold pressure.

7. The snow making tower of claim 1, said nozzle having an inlet tube feeding said first water nozzle from a bottom inlet for said tube which extends downwardly into said elongated tower pipe below said top end of said air conduit.

8. The snow making tower of claim 7, including a second water discharge nozzle positioned adjacent said first water nozzle, said second water nozzle having a separate conduit connected for independently supplying water under pressure from the water source to said second water nozzle for discharge into ambient atmosphere.

9. The snow making tower of claim 8, wherein said second water nozzle is detachable for replacement with nozzles of different aperture size for thereby permitting adjustment for producing a maximum of quality snow under different ambient subfreezing conditions.

10. The snow making tower of claim 8 wherein said first and second water nozzles are inclined toward each other whereby their respective ambient discharges will comingle for providing additional atomization thereof.

11. The snow making tower of claim 8 including a conduit valve connected to said separate conduit for independently regulating the supply of water under pressure to said second water nozzle.

12. The snow making tower of claim 11 wherein said valve is a three-way valve connected for draining said separate conduit when said valve is off.

13. The snow making tower of claim 11 wherein said separate conduit coextends within said tower pipe.

14. The snow making tower of claim 11 wherein said water connection at the lower end of said elongated tower pipe includes a pressure regulating valve connected for regulating the pressure of water supplied to the lower end of said tower pipe, and a water pressure gauge disposed between said pressure regulating valve and said water connection for reading water pressure supplied through said pressure regulating valve to said water connection.

15. The snow making tower of claim 14 including an air valve connected to said air conduit for regulating the supply of air under pressure to said air conduit.

16. The snow making tower of claim 15 including a third water valve connected for regulating the supply of water under pressure to said to said separate conduit and said pressure regulating valve.

17. The snow making tower of claim 16 including an air pressure gauge connected to said air valve for reading air pressure supplied to said air valve.

18. A snow making tower comprising: an elongated pipe snow making tower mounted on a support and having upper and lower ends with snow making nozzles adjacent the upper end and water and air connections at the lower end for respective connection to sources of water and air under pressure, an air conduit substantially coextending within said pipe tower with a bottom end thereof connected to said air connection, said water connection exiting the lower end of said pipe tower in line and said air connection exiting the lower end of said pipe tower at an angle.

19. A method of manufacturing snow comprising the steps of:

supplying water under pressure through an elongated pipe to a first point of discharge above ground;

discharging the supplied water at said first point of discharge through a first nozzle into ambient atmosphere in the form of a spray when the ambient atmosphere is at a temperature lower than the freezing point of water; and independently supplying air under pressure through a conduit substantially coextending within said pipe to a second point of discharge above ground which is internal of said pipe and adjacent said first point of discharge.

20. The method of claim 19 including the step of regulating water pressure within said pipe to be less than the pressure of air being discharged at said second point of discharge.

21. The method of claim 20 including the step of discharging said air under pressure at said second point of discharge through a biased check valve at a predetermined pressure threshold.

22. The method of claim 21 including the step of also discharging the supplied air under pressure into ambient atmosphere in the form of a stream directed into the throat of said sprayed water for further atomizing said sprayed water.

23. The method of claim 19 including the step of discharging water under pressure supplied independently from the source through a second nozzle adjacent said first nozzle into ambient atmosphere and positioning an inlet for said first nozzle within said elongated pipe below said second point of discharge for air.

24. The method of claim 23 including the step of valuing the independent supply of water under pressure to said second nozzle.

25. The method of claim 24 including the step of selectively exchanging said second nozzle with nozzles of different aperture size for thereby regulating the production of maximum quality snow under different ambient subfreezing conditions.

26. The method of claim 25 including the step of directing ambient discharge from said first and second discharge to comingle for providing addition atomization of the discharges.

* * * * *